US008842873B2

(12) United States Patent
Bullimore

(10) Patent No.: US 8,842,873 B2
(45) Date of Patent: Sep. 23, 2014

(54) LOUDSPEAKER WITH AN INVERTED MOTOR

(75) Inventor: George Bullimore, West Glamorgan (GB)

(73) Assignee: Harman Becker Automotive Systems GmbH, Karlsbad (DE)

( * ) Notice: Subject to any disclaimer, the term of this patent is extended or adjusted under 35 U.S.C. 154(b) by 358 days.

(21) Appl. No.: 13/046,323

(22) Filed: Mar. 11, 2011

(65) Prior Publication Data

US 2011/0268310 A1 Nov. 3, 2011

(30) Foreign Application Priority Data

Mar. 12, 2010 (EP) ..... 10156416

(51) Int. Cl.

| | |
|---|---|
| ***H04R 9/06*** | (2006.01) |
| ***H04R 31/00*** | (2006.01) |
| ***H04R 7/26*** | (2006.01) |
| *H04R 9/00* | (2006.01) |
| *H04R 9/04* | (2006.01) |

(52) U.S. Cl.

CPC ..... *H04R 7/26* (2013.01); *H04R 2307/201* (2013.01); *H04R 31/006* (2013.01); *H04R 9/041* (2013.01)

USPC ..... 381/398; 381/416; 381/404; 381/403; 381/407; 381/432; 381/396; 381/405; 381/423; 381/424

(58) Field of Classification Search

USPC ..... 381/398, 416, 404, 432, 407, 403, 396, 381/405, 423, 424

See application file for complete search history.

(56) References Cited

U.S. PATENT DOCUMENTS

| | | | | |
|---|---|---|---|---|
| 5,475,765 | A * | 12/1995 | Lyth | 381/433 |
| 7,016,514 | B2 | 3/2006 | White et al. | |
| 7,382,893 | B2 | 6/2008 | Baeten | |
| 7,539,323 | B2 | 5/2009 | Funahashi et al. | |
| 2004/0240701 | A1 * | 12/2004 | Sahyoun | 381/407 |
| 2005/0008188 | A1 | 1/2005 | Harris | |
| 2006/0177091 | A1 | 8/2006 | Funahashi | |
| 2008/0240488 | A1 | 10/2008 | Funahashi et al. | |

FOREIGN PATENT DOCUMENTS

| | | |
|---|---|---|
| GB | 2360899 | 10/2001 |
| WO | 2005117490 | 12/2005 |
| WO | 2008135857 | 11/2008 |

* cited by examiner

*Primary Examiner* — Curtis Kuntz
*Assistant Examiner* — Thomas Maung
(74) *Attorney, Agent, or Firm* — O'Shea Getz P.C.

(57) ABSTRACT

A loudspeaker includes a chassis, a diaphragm, a motor system, a first suspension and a second suspension. The chassis has an inner periphery and an outer periphery. The diaphragm has an inner periphery and an outer periphery. The motor system has a magnet assembly connected to the inner periphery of the chassis, and a voice coil assembly connected to the diaphragm. The first suspension has an inner periphery connected to the outer periphery of the diaphragm, and an outer periphery connected to the outer periphery of the chassis. The second suspension has an inner periphery connected to at least one of the magnet assembly and the inner periphery of the chassis, and an outer periphery connected to the diaphragm between the inner and outer periphery.

11 Claims, 3 Drawing Sheets

LOUDSPEAKER WITH AN INVERTED MOTOR

CLAIM OR PRIORITY

This patent application claims priority from EP Application No. 10 156 416.9 filed Mar. 12, 2010, which is hereby incorporated by reference.

FIELD OF TECHNOLOGY

The present invention relates generally to moving coil loudspeakers and, more particularly, to loudspeakers with an inverted motor.

RELATED ART

A typical moving coil loudspeaker includes a chassis, a magnet, a cone-shaped diaphragm and a movable voice coil. The chassis supports the magnet and the diaphragm. The diaphragm carries the voice coil, which is suspended from the chassis. The magnet and the voice coil form a motor system of the loudspeaker. Typically, the chassis is positioned behind the diaphragm. Some loudspeakers, however, may have an inverted motor design where both the chassis and at least most of the motor system are positioned in front of the diaphragm to, for example, improve heat dissipation and provide lower profiles. Examples of such loudspeakers are disclosed in U.S. Pat. No. 7,382,893, U.S. Pat. No. 7,016,514, U.S. Publication No. 2005/0008188, and U.K. Publication No. 2,360,899, each of which is incorporated by reference.

SUMMARY OF THE INVENTION

According to one aspect of the invention, a loudspeaker includes a chassis, a diaphragm, a motor system, a first suspension and a second suspension. The chassis has an inner periphery and an outer periphery. The diaphragm has an inner periphery and an outer periphery. The motor system has a magnet assembly connected to the inner periphery of the chassis, and a voice coil assembly connected to the diaphragm. The first suspension has an inner periphery connected to the outer periphery of the diaphragm, and an outer periphery connected to the outer periphery of the chassis. The second suspension has an inner periphery connected to at least one of the magnet assembly and the inner periphery of the chassis, and an outer periphery connected to the diaphragm between the inner and outer periphery.

According to another aspect of the invention, a method is provided for assembling a loudspeaker that includes a chassis, a diaphragm, a motor system having a voice coil assembly and a magnet assembly with a magnetic gap, a first suspension and a second suspension, where the voice coil assembly is connected to the diaphragm, and where an inner periphery of the first suspension is connected to an outer periphery of the diaphragm. The method includes connecting the magnet assembly to an inner periphery of the chassis to form a chassis-magnet assembly; positioning the voice coil assembly in the magnetic gap; connecting an inner periphery of the second suspension to at least one of the magnet assembly and the inner periphery of the chassis; connecting an outer periphery of the first suspension to an outer periphery of the chassis, and the inner periphery of the first suspension to the voice coil assembly; and connecting an outer periphery of the second suspension to the diaphragm.

According to another aspect of the invention, a method is provided for assembling a loudspeaker that includes a chassis, a motor system having a voice coil assembly and a magnet assembly with a magnetic gap, a diaphragm connected to the voice coil assembly, a first suspension and a second suspension. The method includes connecting the magnet assembly to an inside end of the chassis to form a chassis-magnet assembly; positioning the voice coil assembly in the magnetic gap; connecting an inside end of the first suspension to the voice coil assembly and an outside end of the diaphragm; connecting an outside end of the first suspension to an outside end of the chassis; connecting an inside end of the second suspension to at least one of the magnet assembly and the inside end of the chassis; and connecting an outside end of the second suspension to the diaphragm between inside and outside ends of the diaphragm.

The aforesaid loudspeakers advantageously may be lighter in weight, may have a slimmer package (e.g., thinner), may be easier to assemble, may be more reliable, and may have better acoustic performance and a lower cost than a conventional loudspeaker.

DESCRIPTION OF THE DRAWINGS

Aspects of the invention may be better understood with reference to the following drawings and description. Components in the figures are not necessarily to scale, emphasis is instead placed on illustrating the principles of the invention. Moreover, like reference numerals designate corresponding parts throughout the different views. In the figures.

DETAILED DESCRIPTION OF THE INVENTION

Figure 1:
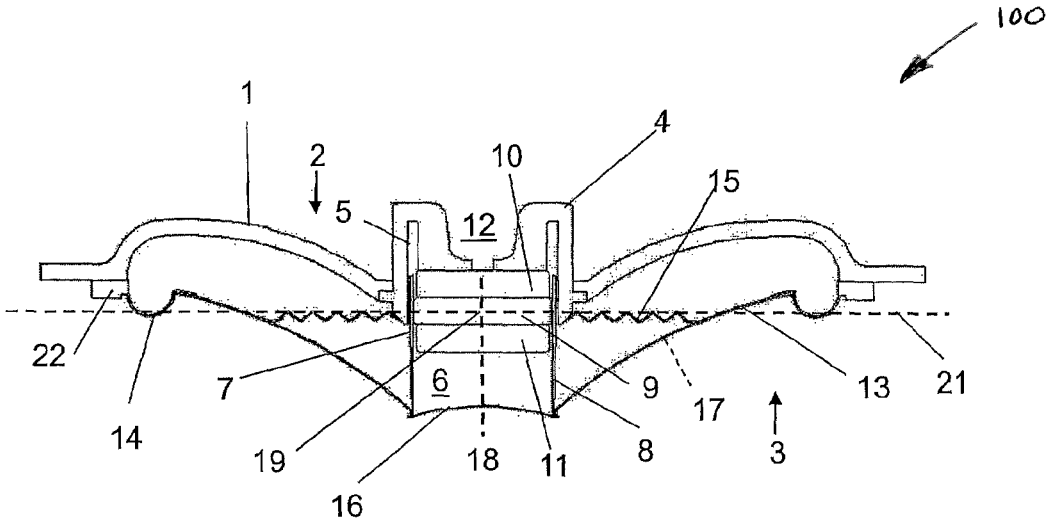
FIG. 1 illustrates a vertical section of a loudspeaker with an inverted cone.

FIG. 1 illustrates a loudspeaker 100 having a dual suspension centering system and an inverted magnet design. The loudspeaker 100 may be configured as a shallow loudspeaker, which is sometimes referred to as a "low-profile loudspeaker", a "compact loudspeaker" or a "flat loudspeaker".

The loudspeaker 100 includes a chassis 1 (e.g., a plastic or metal basket or frame with a central aperture) that includes a front portion 2, a rear portion 3, an outer periphery and an inner periphery. The chassis 1 has a conical, curved shape and supports a rearwardly opening cup-shaped pole piece 4 (also referred to as shell pot). A rearward end of the pole piece 4 may be secured to the chassis 1 at the inner periphery, thereby enclosing the central aperture. The pole piece 4 is formed having an annular recess for accommodating a front edge of a voice coil assembly 6. The voice coil assembly 6 includes a winding 7 (e.g., made from copper wire) that is wound around a cylindrical former 8 with a cylinder axis 18 (e.g., a cylindrical aluminum sheet with an axial slit).

A pole plate 9 is sandwiched between a permanent front magnet 10 located at a closed end of pole piece 4 and a permanent rear magnet 11. The pole plate 9 is arranged with the pole piece 4 to create an annular gap 5 for accommodating the voice coil assembly 6, and generating a radial magnetic field developed between the pole plate 9 and the cylindrical wall of the pole piece 4. The front and rear magnets 10 and 11 may be circular disks made of or including neodymium or any other suitable permanent-magnetic material. The pole plate 9 may be a circular disk made of soft-magnetic material such as steel. The voice coil assembly 6, the pole piece 4, the pole plate 9 and the front and rear magnets 10 and 11 form a motor system 12. The motor system 12 is supported by the chassis 1. In some embodiments, the loudspeaker 100 may be constructed with the front magnet 10, and without the rear magnet 11.

A cone-shaped, inwardly curved diaphragm 13 (sometimes referred to as "membrane" or "cone") has an intermediate portion disposed between an inner periphery and an outer periphery. The outer periphery of the diaphragm 13 is connected to the outer periphery of the chassis 1 through a first suspension, referred to as a surround 14, and a spacer ring 22. In some embodiments, however, the loudspeaker 100 may be constructed without the spacer ring 22. The surround 14 may be an annular lip or a corrugated ring made of resilient material such as rubber, woven cloth or the like. The surround 14 is connected through the spacer ring 22 to the chassis 1 at one end, and directly secured to the diaphragm 13 at its other end. The diaphragm 13 may be made of aluminum, paper, plastics, woven material or composites thereof. The central aperture in the diaphragm 13 may be covered by a dust cap 16. The dust cap 16 may be adhered to the diaphragm 13 or the cylindrical former 8 of the voice coil assembly 6.

A second suspension, referred to as a spider 15, resiliently supports the intermediate portion of the diaphragm 13. The spider 15 centers the voice coil assembly 6 through the inner periphery of the diaphragm 13 to which the voice coil assembly 6 is adhered. The voice coil assembly 6 therefore is moveable within the gap 5. The spider 15 has a disc-like shape with corrugations and a central aperture, and is made from a resilient material such as rubber, woven cloth or the like. The spider 15 has an outer periphery secured to the diaphragm 13 and inner periphery connected to the chassis 1 directly or indirectly through the motor system 12 or through any other speaker element (not shown). The winding 7 is soldered to a plurality of conductors 17 integrated or attached to the diaphragm 13. The conductors 17, for example, may be constructed from a copper or carbon tape, wire or other conductor pre-fitted by the supplier to the diaphragm 13. Flexible wires (e.g., litz wires) or a fabric tape with, for example, integrated litz wires or other flexible conductors attach to the copper tape between the outer periphery of the diaphragm 13 and the outer periphery of the spider 15. The flexible wires are also attached (e.g., soldered, crimped, etc.) to the terminal blades of a connector block (not shown).

The chassis 1, at least most of the motor system 12 and, thus, the voice coil assembly 6 are positioned in front of the diaphragm 13. Relative positions of the magnet and diaphragm therefore are inverted relative to, for example, conventional non-inverted assemblies. The motor system 12 is located substantially outside of the cabinet in ambient air. The ambient air therefore may increase cooling of the motor system 12 via convection and radiation, as well as via conduction to the chassis 1. The permanent magnets 10 and 11 may include rare earth elements (e.g., neodymium), ferrite, etc. The inner diameter of the spider 15 is mounted to the shell pot (i.e., the cup-shaped pole piece 4 of the magnet assembly of the motor system 12) and/or the chassis 1. The outer diameter of the spider 15 is mounted to the diaphragm body. The spider 15 also provides dust ingress protection.

The two suspensions (i.e., the surround 14 and the spider 15) are arranged coplanar with a virtual plane 21 when the diaphragm is at rest. The virtual plane 21 is substantially perpendicular to the axis 18 of the voice coil assembly 6. Non axial movement of the diaphragm-voice-coil-assembly therefore may be reduced. The midpoint 19 of the winding 7 is approximately aligned with both suspensions (i.e., surround 14 and spider 15), which configures a roll center of the software (e.g., the voice coil 7, the cylindrical former 8, the diaphragm 13, the surround 14, and the dust cap 16) at the midpoint 19 of the winding 7. The loudspeaker 100 becomes more resilient to rocking as the roll center approaches the midpoint 19. A relatively large angular tilt of the software therefore is needed for the voice coil assembly 6 to touch the motor system 12. Conventional loudspeakers, in contrast, need merely a relatively small angular tilt to cause a large lateral shift in the voice coil assembly, which may lead to rubbing between the voice coil assembly and the motor system.

The loudspeaker 100 may be thinner than conventional loudspeakers. Furthermore, the depth of the loudspeaker 100 is greatest at the dust cap or neck region of the diaphragm, respectively, which may reduce the overall envelope of the loudspeaker compared to conventional loudspeakers. The loudspeaker 100 may have a reduced height, which may increase shipping density. The loudspeaker 100, in contrast to known slim loudspeaker designs, need not include (i) a hole in the motor system components that may reduce its magnetic strength, (ii) a scrim to seal the motor system since the spider seals the motor system, (iii) a post-plate, (iv) relatively tight tolerances on the motor system hole and post plate, (v) extra reinforcement paper on the voice coil that increases costs for low impedance or four-layer coils (e.g., to allow cone neck to pass over winding), (vi) connectors on the front ("wet") side, and/or (vii) a rain shield. The loudspeaker 100 therefore may include fewer components than conventional loudspeaker designs.

Other slim speaker designs necessitate a cone-shaped diaphragm (e.g., a piston) that has sharp angles along the length of the cone to move the intermediate portion of the piston outside the axial limits of the inner and outer periphery of the piston. Such a cone may provide relatively poor acoustic response because the cone has a natural tendency to flex where there is a sharp change in direction. The loudspeaker 100, in contrast, may have a cone which, in profile, is similar to a cone of a conventional loudspeaker or a cone of an inverted loudspeaker with a chassis on both the front and rearward faces of the loudspeaker.

Figure 2:
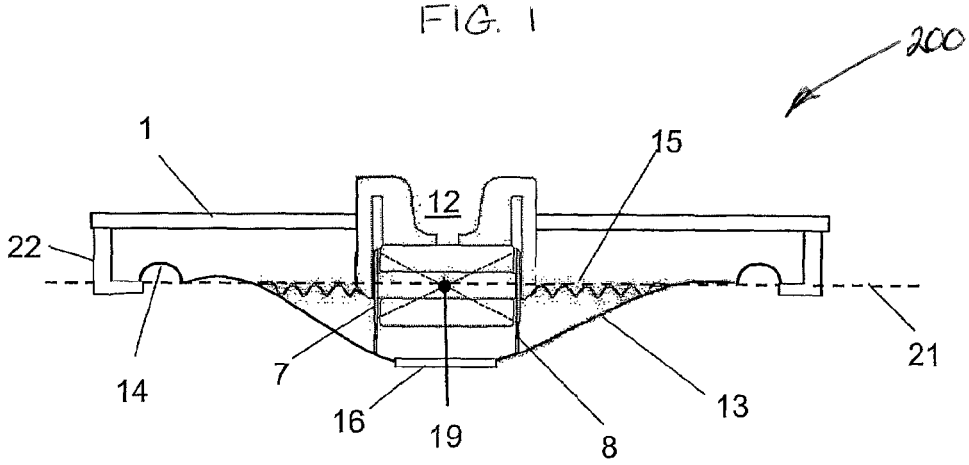
FIG. 2 illustrates a vertical section of a loudspeaker with an s-curved cone.

FIG. 2 illustrates an alternative embodiment of a loudspeaker 200 having a dual suspension centering system and an inverted magnet design. In contrast to the loudspeaker components shown in FIG. 1, the chassis 1 shown in FIG. 2 is flat, the diaphragm 13 is s-curved, the suspension 14 is inwardly curved, and the voice coil assembly 6 is attached to the diaphragm 13 at a point between the inner and outer periphery of the diaphragm 13.

Figure 3:
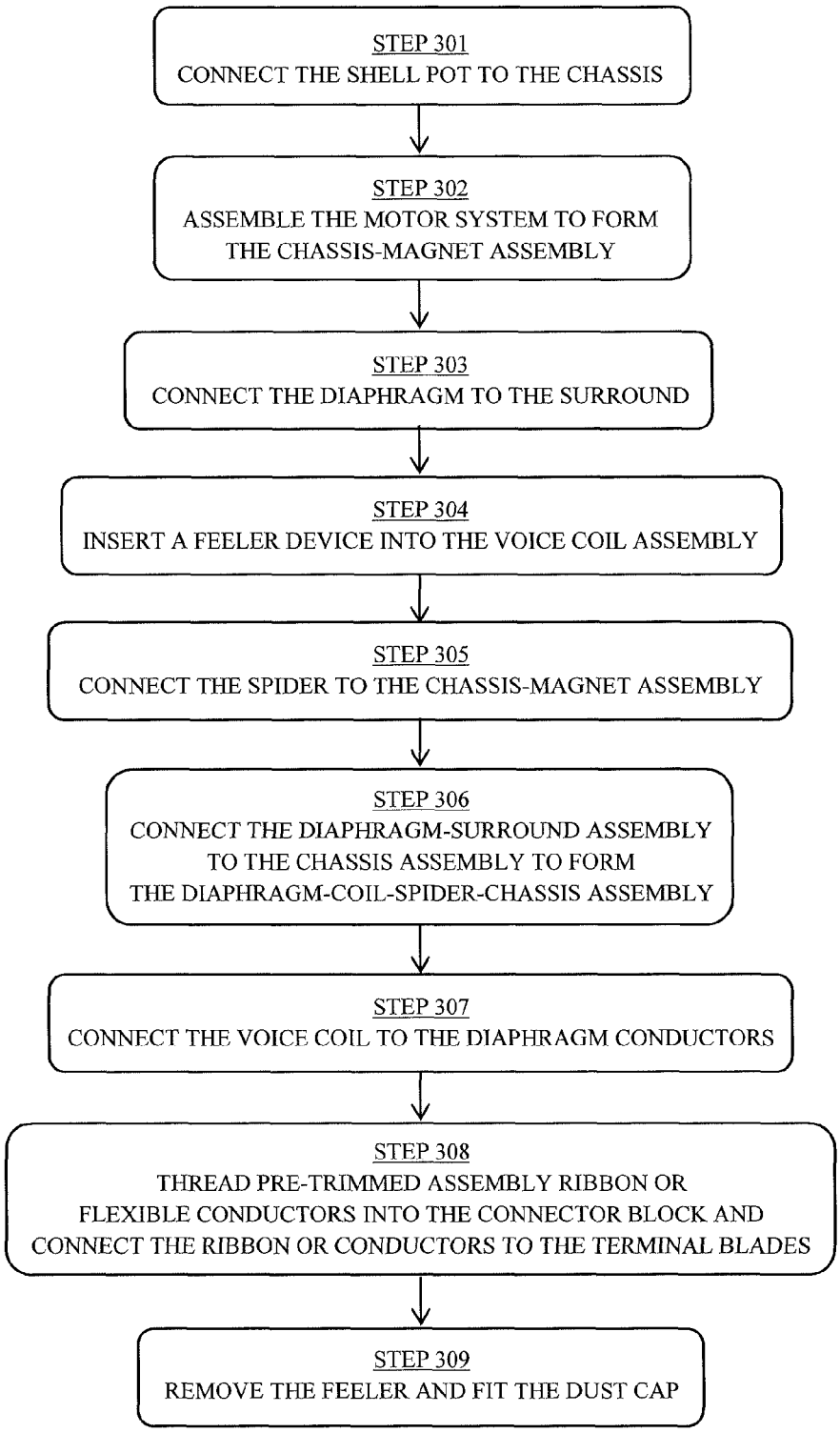
FIG. 3 illustrates a flow diagram of a method for manufacturing the loudspeaker shown in FIG. 1.

FIG. 3 illustrates a flow diagram of a method for manufacturing the loudspeaker 100 shown in FIG. 1. FIGS. 4A to 4D illustrate the loudspeaker at various points during the manufacture method in FIG. 3.

Figure 4A:
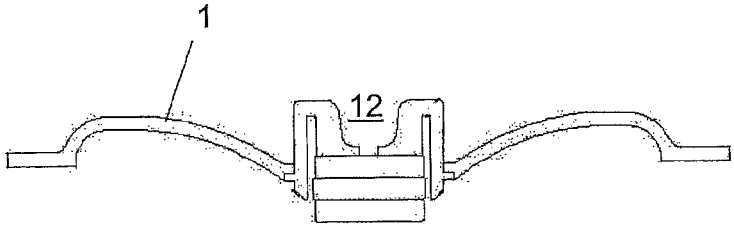
FIGS. 4A-4D illustrate the loudspeaker at various points during the manufacturing method in FIG. 3.
Figure 4B:
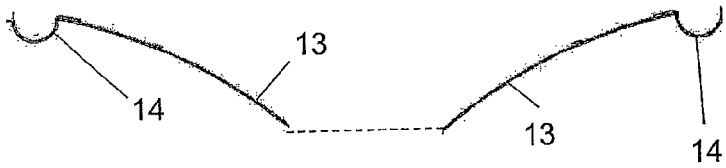
Figure 4C:
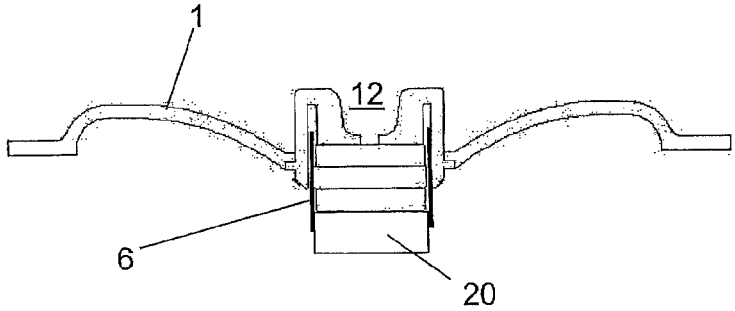
Figure 4D:
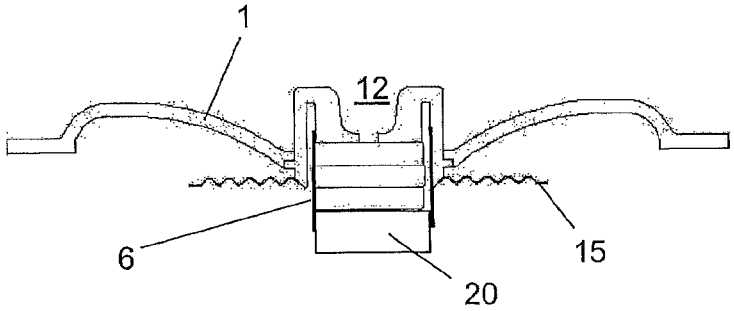

Referring to FIGS. 3 and 4A to 4D, in step 301, the shell pot (e.g., the pole piece 4) is connected (e.g., molded in, staked, bonded or twist-fit) to the chassis 1. In step 302, the motor system 12 is assembled to form a chassis-magnet assembly as shown in FIG. 4A. In step 303, the diaphragm 13 is connected to the surround 14 to form an assembly as shown in FIG. 4B. In step 304, a feeler gauge 20 forming a centering device is inserted into the voice coil assembly 6, which is fitted to the motor system 12 as shown in FIG. 4C. In step 305, the spider 15 is connected (e.g., glued) to the chassis-magnet assembly as shown in FIG. 4D. In step 306, the diaphragm-surround assembly is connected to the chassis assembly to form a diaphragm-coil-spider-chassis assembly. In step 307, the voice coil 7 is connected (e.g., soldered) to the diaphragm conductors 17 (not shown). In step 308, the pre-trimmed assembly ribbon or flexible conductors are threaded into the connector block (not shown) and connected (e.g., soldered) to the terminal blades (not shown). In step 309, the feeler is removed and the dust cap 16 is fitted to produce the loudspeaker shown in FIG. 1.

The steps in FIG. 3 and, in particular, steps 303 to 306 may be performed in any order. In some embodiments, step 303 may be performed before, during or after the completion of steps 301 and/or 302.

While various embodiments of the invention have been described, it will be apparent to those of ordinary skill in the art that other embodiments and implementations are possible that are within the scope of this invention. Accordingly, the invention is not restricted except in light of the attached claims and their equivalents.

What is claimed is:

1. A loudspeaker, comprising:

a chassis having an inner periphery and an outer periphery;

a diaphragm having an inner periphery and an outer periphery;

a motor system having a magnet assembly connected to the inner periphery of the chassis, and a voice coil assembly connected to the diaphragm and having a voice coil axis;

a first suspension having an inner periphery connected to the outer periphery of the diaphragm, and an outer periphery connected to the outer periphery of the chassis; and a second suspension having an inner periphery connected to at least one of the magnet assembly and the inner periphery of the chassis, and an outer periphery connected to the diaphragm between the inner and outer periphery, where the first and second suspensions are arranged substantially coplanar when the diaphragm is at rest and substantially perpendicular to the voice coil axis.

2. The loudspeaker of claim 1, where the voice coil is connected to one of the inner and outer periphery of the diaphragm.

3. The loudspeaker of claim 1, where the voice coil is connected to the diaphragm between the inner and outer periphery of the diaphragm.

4. The loudspeaker of claim 1, where the diaphragm has a conical shape.

5. The loudspeaker of claim 1, where the diaphragm is curved.

6. The loudspeaker of claim 5, where the diaphragm is curved in a plurality of directions.

7. The loudspeaker of claim 1, further comprising a dust cap connected to at least one of the inner periphery of the diaphragm and the voice coil assembly.

8. The loudspeaker of claim 7, where the dust cap is an integral part of the diaphragm.

9. The loudspeaker of claim 1, where the chassis has one of a conical, curved and flat shape.

10. The loudspeaker of claim 1, where the voice coil assembly comprises a winding having a midpoint that is substantially aligned with the first and second suspensions when the diaphragm is at rest.

11. The loudspeaker of claim 1, where at least one of the first suspension has a curved shape that one of extends outwardly, extends inwardly, and comprises a plurality of corrugations; and the second suspension is corrugated.

* * * * *